US006010081A

United States Patent [19]

Park et al.

[11] Patent Number: 6,010,081

[45] Date of Patent: Jan. 4, 2000

[54] INTERCHANGEABLE AND ROTATABLE TWIN-FLUID ATOMIZER

[75] Inventors: Byung-Kyu Park, Daejeon-Si; Joon-Sik Lee, Seoul; Hyo-Bong Kim, Daejeon-Si, all of Rep. of Korea

[73] Assignee: Korea Institute of Machinery & Metals, Daejeon-Si, Rep. of Korea

[21] Appl. No.: 09/049,010

[22] Filed: Mar. 27, 1998

[30] Foreign Application Priority Data

Dec. 1, 1997 [KR] Rep. of Korea ..... 97-65090

[51] Int. Cl.[7] ..... B05B 1/28; B05B 7/06

[52] U.S. Cl. ..... 239/301; 239/424

[58] Field of Search ..... 239/290, 291, 239/299, 300, 301, 423, 424

[56] References Cited

U.S. PATENT DOCUMENTS

| | | | |
|---|---|---|---|
| 3,827,632 | 8/1974 | Rymarchyk et al. | 239/423 X |
| 4,194,874 | 3/1980 | Voorheis et al. | 239/423 |
| 5,234,168 | 8/1993 | Abboud | 239/424 |
| 5,322,510 | 6/1994 | Lindner et al. | 239/423 X |

*Primary Examiner*—Lesley D. Morris
*Assistant Examiner*—Sean P. O'Hanlon
*Attorney, Agent, or Firm*—Nikaido, Marmelstein, Murray & Oram LLP

[57] ABSTRACT

A twin-fluid atomizer including upper and lower plates connected to each other by the use of bolts; gas supply pipes each provided to the side of the upper plate; a liquid delivery tube defining an orifice and fixed to the top of the upper plate by the use of a bolt; and a connector body fixed to the lower plate and the outer wall of the orifice of the liquid delivery tube, thus defining an annular gas supply channel. The lower plate has an interchangeable connector stem attachable to the connector body and rotatable via cogs formed on the connector stem. The orifice of the liquid delivery tube and connector forming an annular gas flow passage have outlets with a plane or oblique cross section respectively, and the plane or oblique cross section of each outlet is adjusted and/or rotated to provide a symmetric or asymmetric spray pattern. A bushing interposed between the liquid delivery tube and the upper plate to adjust the length of a protrusion of the liquid delivery tube.

5 Claims, 8 Drawing Sheets

INTERCHANGEABLE AND ROTATABLE TWIN-FLUID ATOMIZER

BACKGROUND OF THE INVENTION

1. Field of the Invention

The present invention relates to a twin-fluid atomizer. More particularly, it relates to a twin-fluid atomizer used for disintegrating a relatively high-viscosity liquid into droplets and forming a spray. The atomizer is interchangeably and rotatably installed to assure high atomization efficiency and control spatial size distribution of atomized droplets of liquid.

2. Discussion of Related Art

Generally, a conventional atomizer which atomizes a liquid is fixed in phase and has a symmetric spray pattern. This conventional spray nozzle makes possible to obtain desired spray characteristics experimentally by regulating the pressure of gas chamber and thereby setting flow rate and gas flow pattern downstream of liquid delivery tube. A spray nozzle can be required to produce an asymmetric spray pattern according to a field of application. In such an occasion, the spray pattern may be controlled by moving or tilting the nozzle. However, it is difficult to tilt the entire conventional nozzle assembly of confined type during thermal spray, spray coating, etc. To solve these problems, it is developed to use a tilting ring issuing secondary gas jets in free ball type atomizer. But this is basically inferior to the atomizer of confined type.

SUMMARY OF THE INVENTION

Accordingly, the present invention is directed to an interchangeable and rotatable twin-fluid atomizer that substantially obviates one or more of the problems due to limitations and disadvantages of the related art.

It is an object of the present invention to provide an interchangeable and rotatable twin-fluid atomizer in which the inclination angle of each outlet of its orifice and gas supply channel is controlled for providing a symmetric or an asymmetric spray pattern, and the oblique section of each outlet is controlled in direction by rotation for obtaining spatial size distribution of atomized droplets of liquid, thus assuring high atomization efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is disclosed a twin-fluid atomizer including upper and lower plates connected to each other by the use of bolts; gas delivery tubes each provided to the side of the upper plate; a liquid delivery tube defining an orifice and fixed to the top of the upper plate by the use of a bolt; and a connector coupled to the lower plate and having an interior with the orifice of the liquid delivery tube, thus defining an annular gas passage of gas flow.

The lower plate defines a connector stem detachable from the connector and rotatable via cogs formed on the connector stem.

The orifice of the liquid delivery tube and the annular passage of gas flow each have an outlet with a plane or oblique section, and the plane or oblique section of each outlet is controlled in direction to provide a symmetric or an asymmetric spray mechanism. The oblique section of each outlet is formed in the range of 0° to 60°. A bushing is interposed between the liquid supply pipe and the upper plate to control the length of a protrusion of the liquid supply pipe.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Reference will now be made in detail to the preferred embodiments of the present invention, examples of which are illustrated in the accompanying drawings.

Figure 1:
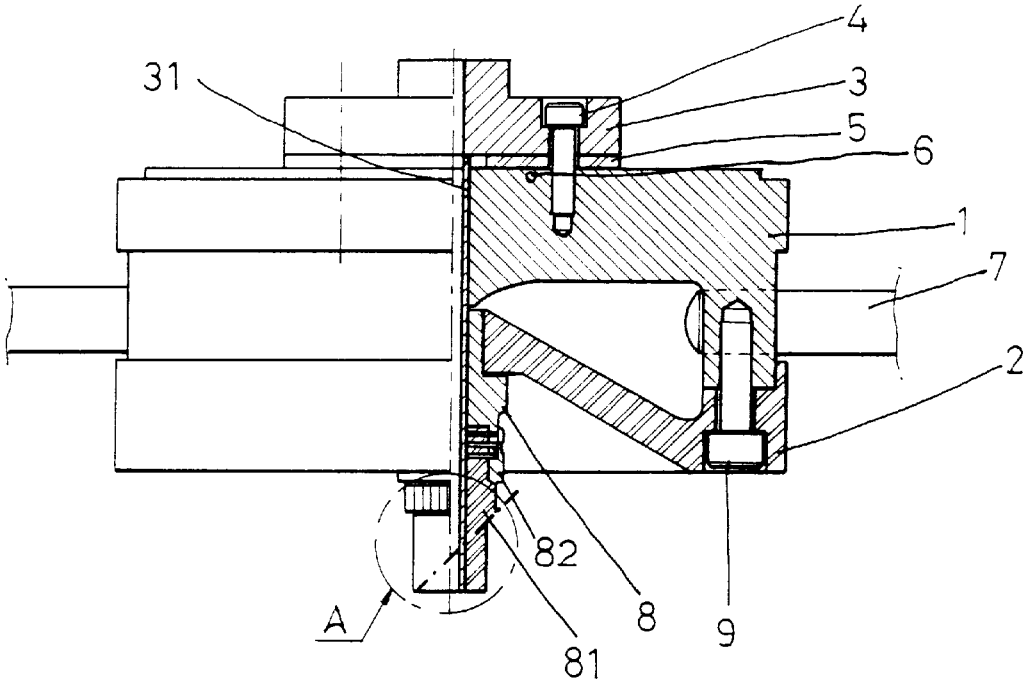
FIG. 1 is a sectional view of a detachable and rotary twin-fluid spray nozzle in accordance with the present invention.
Figure 3:
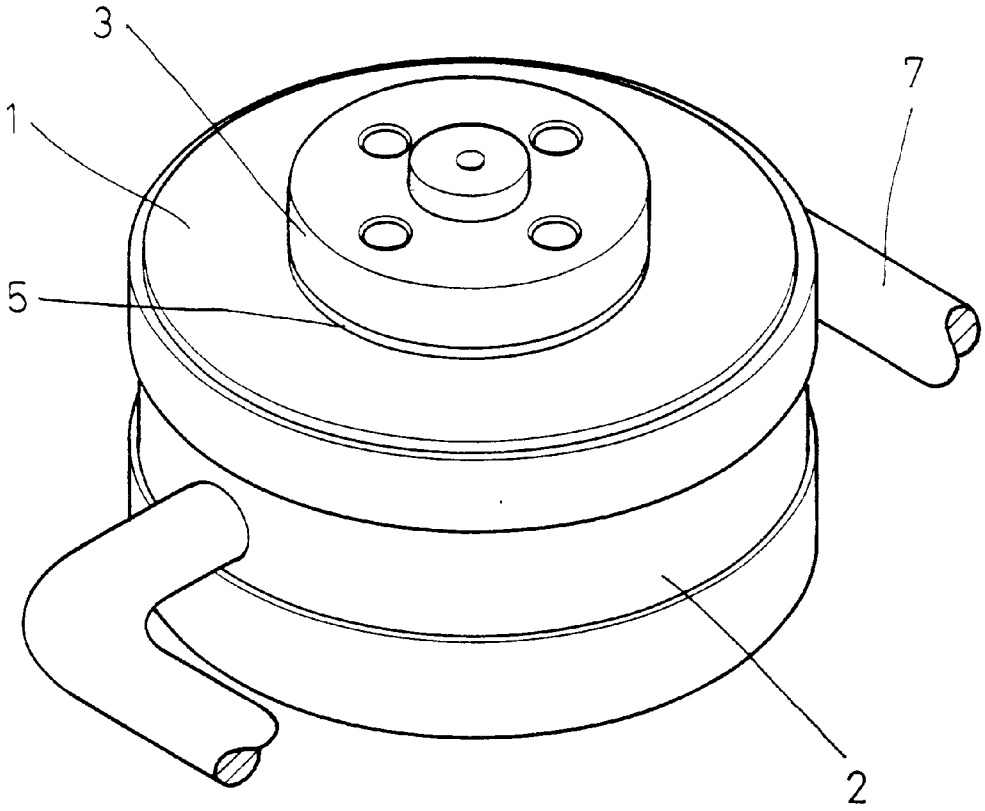
FIG. 3 is a perspective view of the inventive detachable and rotary twin-fluid spray nozzle.
Figure 4:
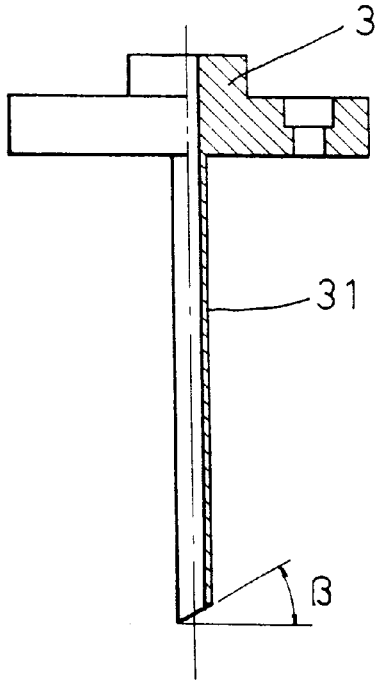
FIG. 4 depicts an orifice for a liquid supply pipe of the inventive interchangeable and rotary twin-fluid spray nozzle.
Figure 4:
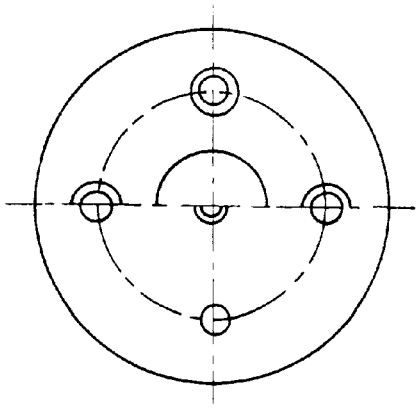
Figure 5:
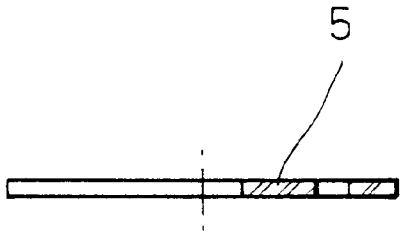
FIG. 5 depicts a bushing used for controlling the length of a projection of the liquid supply pipe in accordance with the present invention.
Figure 5:
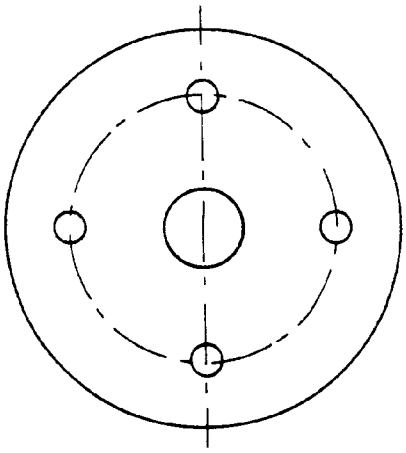
Figure 6:
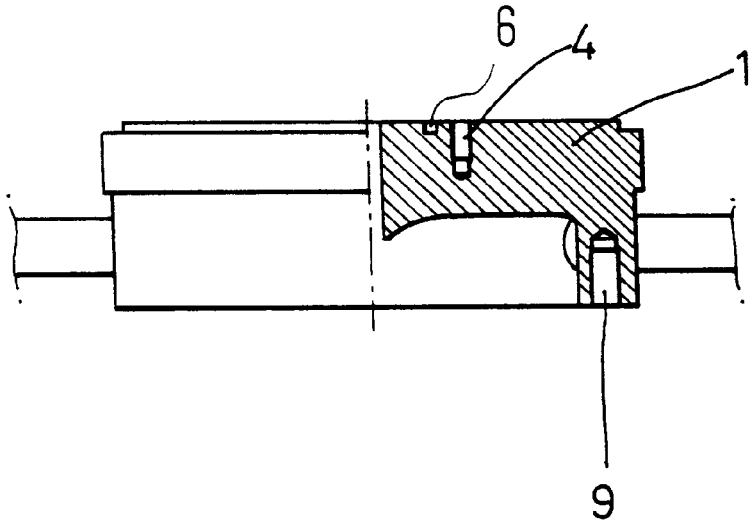
FIG. 6 depicts an upper plate and a gas supply pipe of the inventive detachable and rotary twin-fluid spray nozzle.
Figure 6:
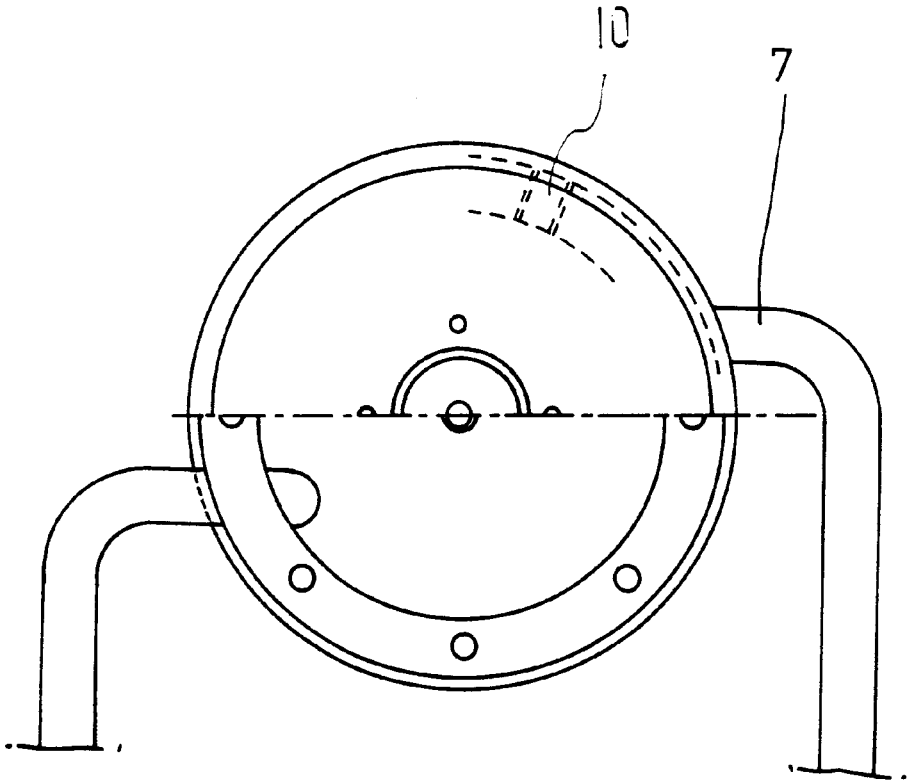
Figure 7:
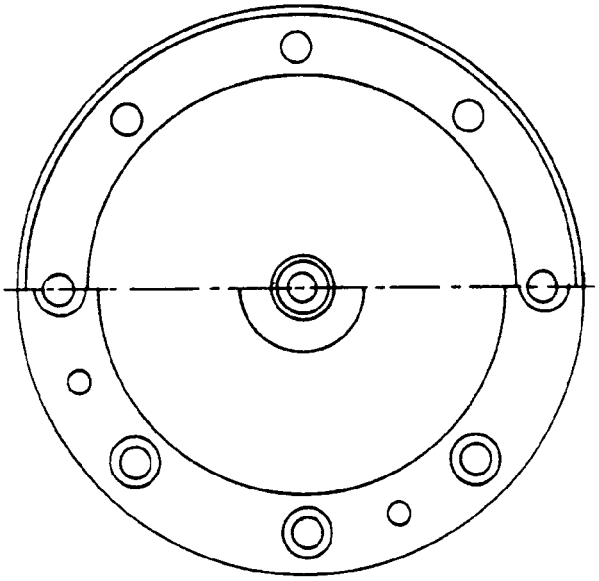
FIG. 7 depicts a lower plate of the inventive detachable and rotary twin-fluid spray nozzle.
Figure 7:
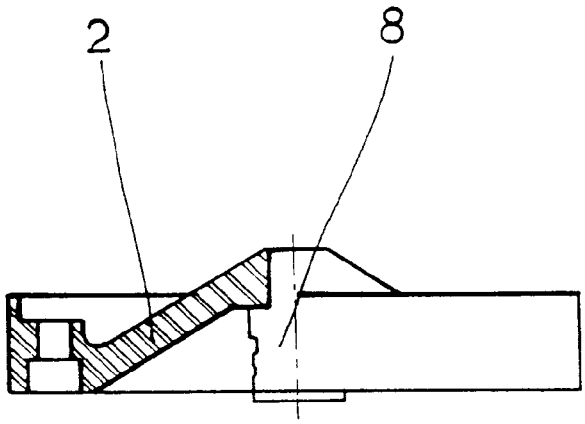

FIG. 1 is a sectional view of a detachable and rotary twin-fluid spray nozzle in accordance with the present invention. FIG. 3 is a perspective view of the inventive detachable and rotary twin-fluid spray nozzle which includes upper and lower plates 1 and 2, a liquid supply pipe 3, gas supply pipes 7, and a connector 8.

The upper and lower plates 1 and 2 are connected to each other via bolts 9, and the liquid and gas supply pipes 3 and 7 are provided to the upper plate 1. A bushing 5 is interposed between the upper plate 1 and liquid supply pipe 3 fixed by a bolt 4.

Each of the bolts 4 and 9 used for connection of the bushing 5 and liquid supply pipe 3 and the upper and lower plates 1 and 2 is configured for insertion into a race. The liquid supply pipe 3 defines a nozzle extension pipe 31 having an outlet with an oblique section formed at an appropriate angle β.

An annular gas supply channel is defined between the pipe 31 and the connector 8. The connector 8 is configured for rotation by cogs formed on an outer surface of a connector stem 81, and has an outlet with a plane or oblique section cut at angle $\alpha$, thus providing a symmetric or asymmetric spray mechanism.

The connector 8 is coupled to the lower plate 2, and the annular gas supply channel is created between the interior of the connector 8 and the extension pipe 31 of the liquid supply pipe 3. The outlet of the extension pipe 31 of each of the liquid supply pipe 3 and the end of connector stem 81 has an oblique section formed by the appropriate angle $\beta$ and $\alpha$ for the asymmetric spray mechanism. The connector stem 81 having the cogs is rotatably coupled to the connector 8.

Figure 8:
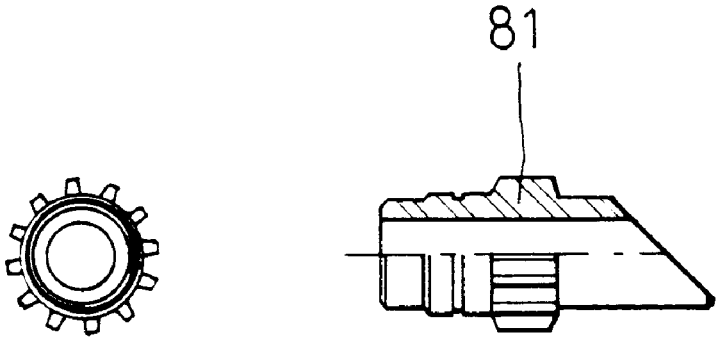
FIG. 8 depicts a stem with an oblique section at its outlet in the inventive detachable and rotary twin-fluid spray nozzle.
Figure 9:
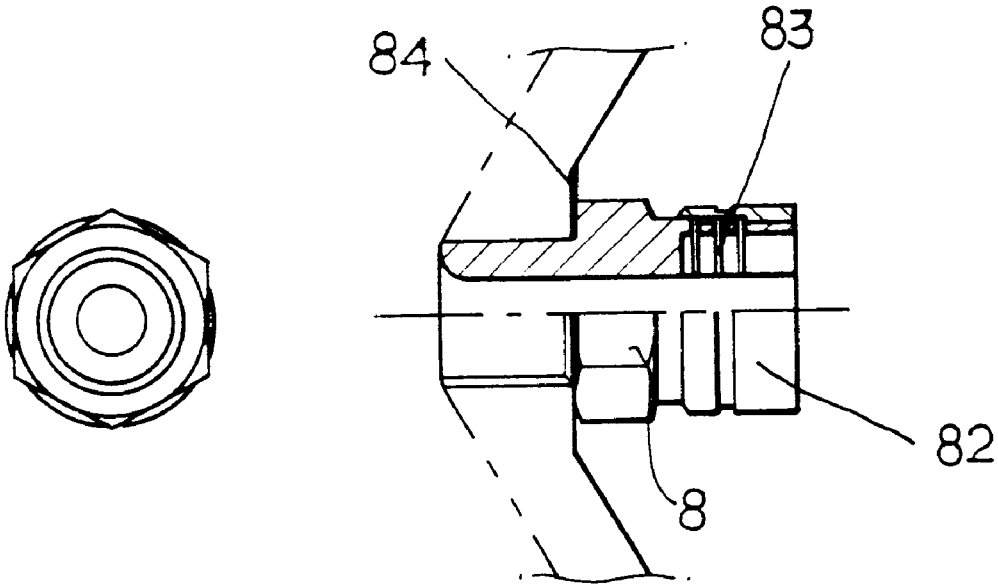
FIG. 9 depicts a detachable and rotary-type nozzle body having an outlet of oblique section in accordance with the present invention.

Reference numeral 6 denotes an O ring slot used as an airtight seal. The inventive twin-fluid spray nozzle is of wide application and controls dispersion of atomized mist of liquid, thus enhancing atomization by employing the detachable connector 8 with connector stem inserted into a quick-connect sleeve 82 biassed by spring 83, as shown in FIGS. 1 and 8.

As described above, the outlet section of the liquid supply pipe 3 and that of the orifice 31 are inclined by $\beta$ and $\alpha$ respectively, thus providing the asymmetric spray mechanism, wherein $0° \leqq \alpha$ and $\beta \leqq 60°$ (FIGS. 1, 2, 4, 8, and 9). The cogs of the connector stem 81 are designed to enable rotation of the connector stem 81, which facilitates control of spatial distribution of atomized mist, referring to FIGS. 1, 8, and 9.

Figure 2:
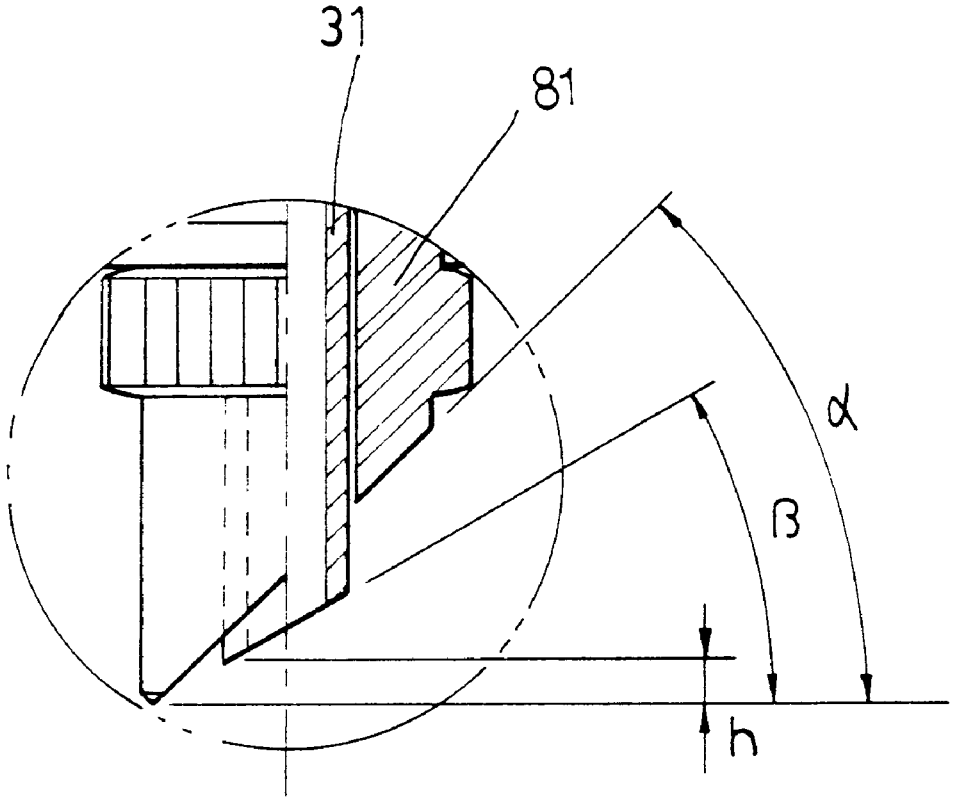
FIG. 2 is an enlarged view of "A" of FIG. 1.

Referring now to FIG. 2, the length of a projection h is controlled to meet the conditions of atomization for the enhancement of atomization efficiency. Reference numeral 84 denotes a cover washer.

As described above, the inventive twin-fluid spray nozzle employs various types of detachable and rotary connectors to lower the production cost, and controls spatial distribution of atomized mist, thus enhancing atomization.

It will be apparent to those skilled in the art that various modifications and variations can be made in the twin-fluid spray nozzle of the present invention without departing from the spirit or scope of the invention. Thus, it is intended that the present invention cover the modifications and variations of this invention provided they come within the scope of the appended claims and their equivalents.

What is claimed is:

1. A twin-fluid spray nozzle comprising:

upper and lower plates connected to each other by the use of bolts and defining a space therebetween;

gas supply pipes each provided to the side of the upper plate;

a liquid supply pipe fixed to the top of the upper plate by the use of a bolt and including an extension pipe extending through said space and said lower plate; and a connector coupled to the lower plate and having an interior through which said extension pipe passes, said connector being connected with, said space thus defining an annular gas supply channel between said interior and an outer surface of said extension pipe, wherein the extension pipe of the liquid supply pipe and the annular gas supply channel each have an outlet cut at an angle to a center axis.

2. A twin-fluid spray nozzle according to claim 1, wherein the connector has a connector stem detachable from the connector and rotatable via cogs formed on the connector stem.

3. A twin-fluid spray nozzle according to claim 1, wherein the extension pipe of the liquid supply pipe and the annular gas supply channel each have an outlet cut at an angle to a center axis, and wherein an angled portion of said outlet of each of the extension pipe and the gas supply channel is controlled in direction to provide a symmetric or asymmetric spray mechanism.

4. A twin-fluid spray nozzle according to claim 1, wherein the angle of each outlet is formed in the range of 0° to 60°.

5. A twin-fluid spray nozzle according to claim 1, further comprising a bushing interposed between the liquid supply pipe and the upper plate to control the length of a protrusion of the extension pipe of liquid supply pipe.

* * * * *